United States Patent [19]

Rocquin

[11] 4,385,742

[45] May 31, 1983

[54] HANGING PLANTER APPARATUS

[76] Inventor: Camille J. Rocquin, 1410 Demosthenes St., Metairie, La. 70005

[21] Appl. No.: 209,731

[22] Filed: Nov. 24, 1980

[51] Int. Cl.[3] ..... A47H 1/10

[52] U.S. Cl. ..... 248/318

[58] Field of Search ..... 248/128, 153, 163 A, 248/312.1, 318, 359; 47/67

[56] References Cited

U.S. PATENT DOCUMENTS

| | | | |
|---|---|---|---|
| 770,738 | 9/1904 | Chessman | 248/318 |
| 1,095,504 | 5/1914 | Jannoch | 47/67 |
| 1,331,680 | 2/1920 | Sherwood | 248/318 |
| 3,854,242 | 12/1974 | Gladstein | 47/67 X |
| 4,262,873 | 4/1981 | Prenger | 248/318 |

*Primary Examiner*—William H. Schultz

*Attorney, Agent, or Firm*—Thomas S. Keaty

[57] ABSTRACT

A support for suspending a flower pot from an overhead structure. In one embodiment the device comprises an annulus for engagement with the lower surface of a shoulder on the pot, the annulus having lateral projections for engagement with suspending hooks. In another embodiment the device comprises an annulus for engagement with the lower surface of an annulus lip on a plastic flower pot, the annulus having a plurality of projections extending upwardly through slots in the lip for engagement with suspending hooks.

3 Claims, 5 Drawing Figures

HANGING PLANTER APPARATUS

BACKGROUND OF THE INVENTION

1. Field of the Invention

The present invention relates to hanging plants. More particularly, the present invention relates to an apparatus for hanging or supporting plants or the like with the use of an improved wire and planter hanging system.

2. General Background and Prior Art

In the area of planters and hanging planters in particular, there is a need for a type of planter wherein the hanging apparatus which supports the plant and plant container is of a sturdy structure for several reasons. First of all, many species of plants when implanted in dirt are extremely heavy and must therefore, if they are to hang properly, be supported by a strengthened hanging apparatus. Secondly in the use of clay pots for hanging plants, it is often times that a clay pot is subjected to unusual stress and therefore, a crack in the clay results. In that case, it is necessary that when the clay pot is supported in such a state, that the support means be of a nature that the crack will not develop further into an actual break, and the pot may be continued to be utilized in its present state.

Also, in recent years, there has developed a popular use for pots which are made of plastic, evidently for reduced expense in manufacture and upkeep. Those pots which are on the market at present, would be hung simply by the use of a wire strung through holes in a top lip of the pots. However, when excessively heavy plants are placed in such pots, the plastic bearing the wire hanging apparatus eventually tears or breaks, resulting, of course, in damage to the pots, which in most cases, requires that the pot be discarded.

The prior art exhibits several types of hanging planter apparatuses, discussed herein:

U.S. Pat. No. 3,867,788, issued to R. C. Mickelson, entitled "Plant Carrier", would disclose a carrier for holding a plant in its soil that would include an open-ended enclosure. The hanging apparatus would be provided through pairs of holes in the lip of the apparatus.

U.S. Pat. No. 3,854,242, issued to A. Gladstein, entitled "Support Structure for a Receptacle or the Like" would teach the use of a support structure having a plurality of securing hooks in "S" shaped configuration and being utilized in a tied manner through a series of hangers off of each "S" hook.

U.S. Pat. No. 3,081,058, issued to F. Devries, et al, entitled "Pendulus Display" would teach the use of a display unit, wherein a configuration of cross-wires would be supporting a plate, the ends of the wires attaching to hanging wires for hanging the entire apparatus in its use.

U.S. Pat. No. 858,543, issued to A. H. Sickmiller, entitled "Wire Basket", would teach the use of a configuration of wires which would basically encircle a hanging plant and enable the plant to grow out of the spaces between the wires.

U.S. Pat. No. Des. 240,383, issued to Dale G. Connell, entitled "Pendant Drip Receptacle for Hanging Potted Plants", would exhibit the use of a flat plate or the like hanging from a pair of wire hangers, with hooks on each hanger for supporting the hanger in certain areas.

GENERAL DISCUSSION OF THE PRESENT INVENTION

The apparatus of the present invention would provide for an improved device for hanging plants, in particular for hanging clay plant pots. The apparatus would comprise a heavy-duty wire or the like for supporting the clay pot, said wire being situated around the exterior of the pot directly below an annular shoulder portion and defining a circumferential support for the pot. The wire would have bows which would extrude outward beyond the thickness of the annular shoulder portion of the pot, so that support wires could be attached thereto, and enable the pot to hang level from the support wires. The support portion of the hanging apparatus would be attached to the hanging wires by a series of modified "S" hooks for easy insertion and removal therefrom.

In an additional embodiment of the apparatus, the apparatus would be utilized in support of plastic or the like plant containers which have an uppermost annular lip portion defining the top edge of the pot, which at present are usually constructed so that a wire or the like hanger may be inserted through a pair of orifices in the annular lip at equal intervals around the outer edge, enabling the apparatus to hang from said wires. However, as discussed previously in the prior art section, such a construction, oftentimes results in the plastic lip portion bending or tearing due to the excessive weight of the plant and the soil in the container. The embodiment of the apparatus, would allow a continuous wire to be inserted beneath the annular lip of the plastic or the like plant container. At three equal intervals around the lip, the continuous wire would form an upward extending bulge which would extrude out from a slot in the lip portion, thus, at each interval along the lip portion, exhibiting a bowed section of wire wherein a hanging wire could be attached thereto. The support of the plastic or the like pot therefore would be via the annular lip portion, along its continual circumference, therefore more thoroughly distributing the weight of the plant and the soil around the entire lip, the result being much reduced stress on individual sections of the lip portion itself, and thus, extending the life of the planter.

Therefore, it is more an object of the present invention to provide a hanging planter apparatus for hanging plants contained in clay pots, with the use of a continuous wire around an annular shoulder portion of the pot.

It is another object of the present invention to provide a hanging planter apparatus having a plurality of bulges for attachment to hanger wires.

It is another object of the present invention to provide a hanging planter apparatus having the ability to support a pot of the clay-type while reducing the possibility of the pot cracking and/or breaking.

It is another object of the present invention to provide a hanging planter apparatus wherein the hanging wires are continuous strands, connected to a pot support portion with a series of modified "S" support hooks.

It is a further object of the present invention to provide a hanging planter apparatus wherein the continuous wire would be adapted with a series of upward extending bulges for extrusion through a plastic or the like lip portion at equal intervals around the lip.

It is another object of the present invention to provide a hanging planter apparatus adapted for plastic or the like plant containers for equally distributing the weight of the container around the lip portion of the plastic pot.

It is still a further object of the present invention to provide a hanging planter apparatus which is simple in construction, easy to use, and sturdy for containing plants and the soil around said plant.

BRIEF DESCRIPTION OF THE DRAWING

For further understanding of the nature and object of the present invention, reference should be had to the following detailed description, taken in conjunction with the accompanying drawings, in which like parts given like reference numerals and wherein.

DETAILED DESCRIPTION OF THE PREFERRED EMBODIMENT

Figure 1:
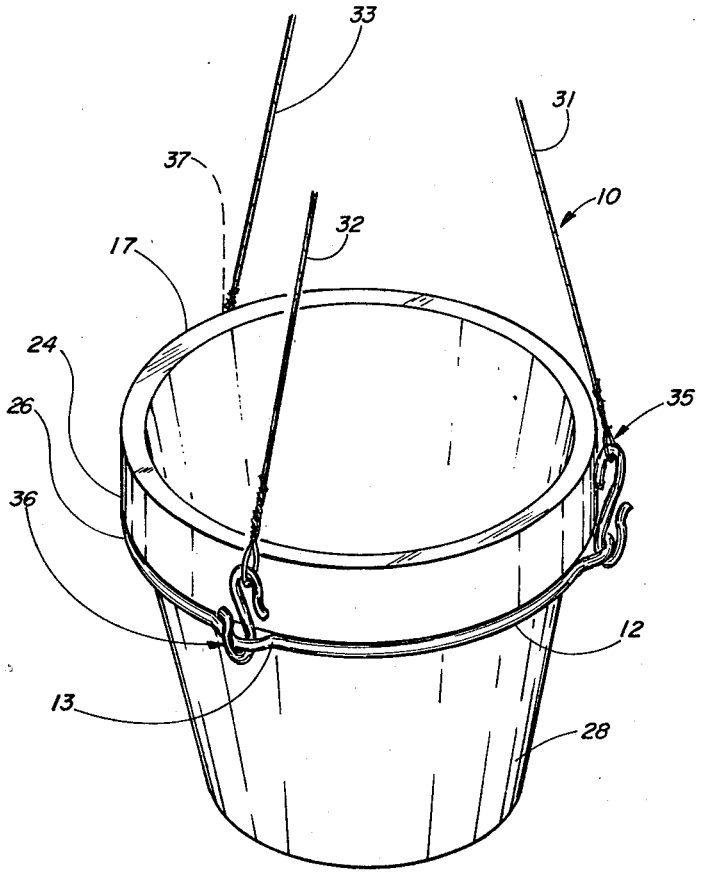
FIG. 1 is a perspective view of the preferred embodiment of the apparatus of the present invention wherein the apparatus is shown supporting a plant pot.

FIG. 1 best illustrates the preferred embodiment of the apparatus designated generally by the numeral 10. Apparatus 10 would comprise continuous wire 12 encasing the exterior upper portion of pot 28, situated directly beneath the annular shoulder 24 of pot 28 so that the lower edge 26 of annular shoulder 24 rests on continuous wire 12. FIG. 1 further illustrates extrusions 13 and 14 located approximately one-third ($\frac{1}{3}$) the circumferential distance of the exterior surface of pot 28 and, although not shown, would contain a third extrusion 17, thus the three extrusions defining three equally spaced bulges around the exterior of said continuous wire 12. As further illustrated in FIG. 1, these extrusions would act to support wires 31, 32 and 33 which are secured to continuous wire 12 with a series of modified "S" hooks 35, 36 and 37 respectively for allowing said hanger wires to be placed onto the extrusions 13, 14 and 17 respectively for supporting pot 28.

Figure 2:
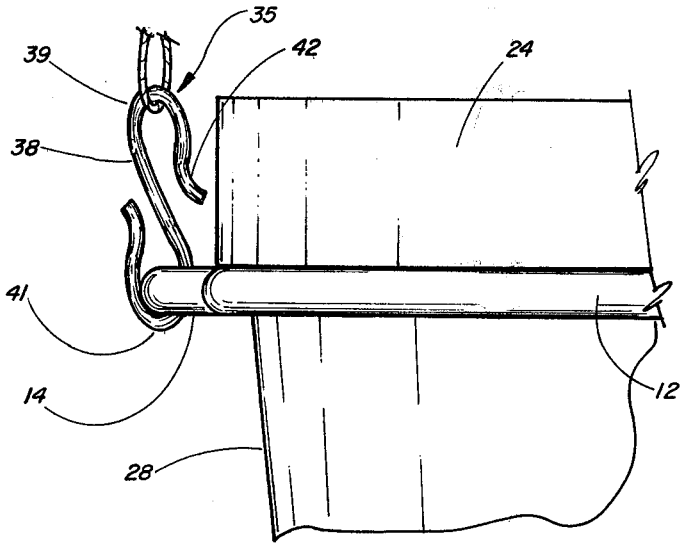
FIG. 2 is a cutaway exploded view of the apparatus of the present invention illustrating the connection of the continuous wire and the support portion at one interval along the shoulder of the hanging pot, with the use of the modified "S" hook.

As further illustrated more closely in exploded view in FIG. 2, it should be noted that extrusions 13, 14 and 17, would necessarily extend beyond shoulder portion 24 of hanging pot 28. This is important, since it is necessary that the hanging wires 31, 32 and 33 be allowed to connect onto modified "S" portions 35, 36 and 37 respectively without making direct contact with shoulder portion 24 of hanging pot 28. Hangar wires 31, 32 and 33, if allowed to make contact with, and possibly apply pressure onto said shoulder portion 24, may result in shoulder portion 24 being damaged.

Figure 3:
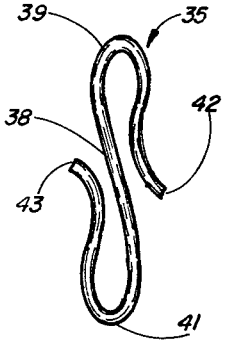
FIG. 3 is an exploded view of the modified "S" hook of the preferred embodiment of the apparatus of the present invention.

FIG. 3 best illustrates the modified "S" hook for example number 35, which comprises a continuous wire 38 defining a top loop portion 39 and a bottom loop portion 41, with the ends 42 and 43 of said modified "S" hook 35 allowing insertion into upper loop 39 and bottom loop 41 for allowing hanging of clay pot 28 via continuous wire 12 attached to modified "S" hooks, 35, 36 and 37.

Figures 4, 5:
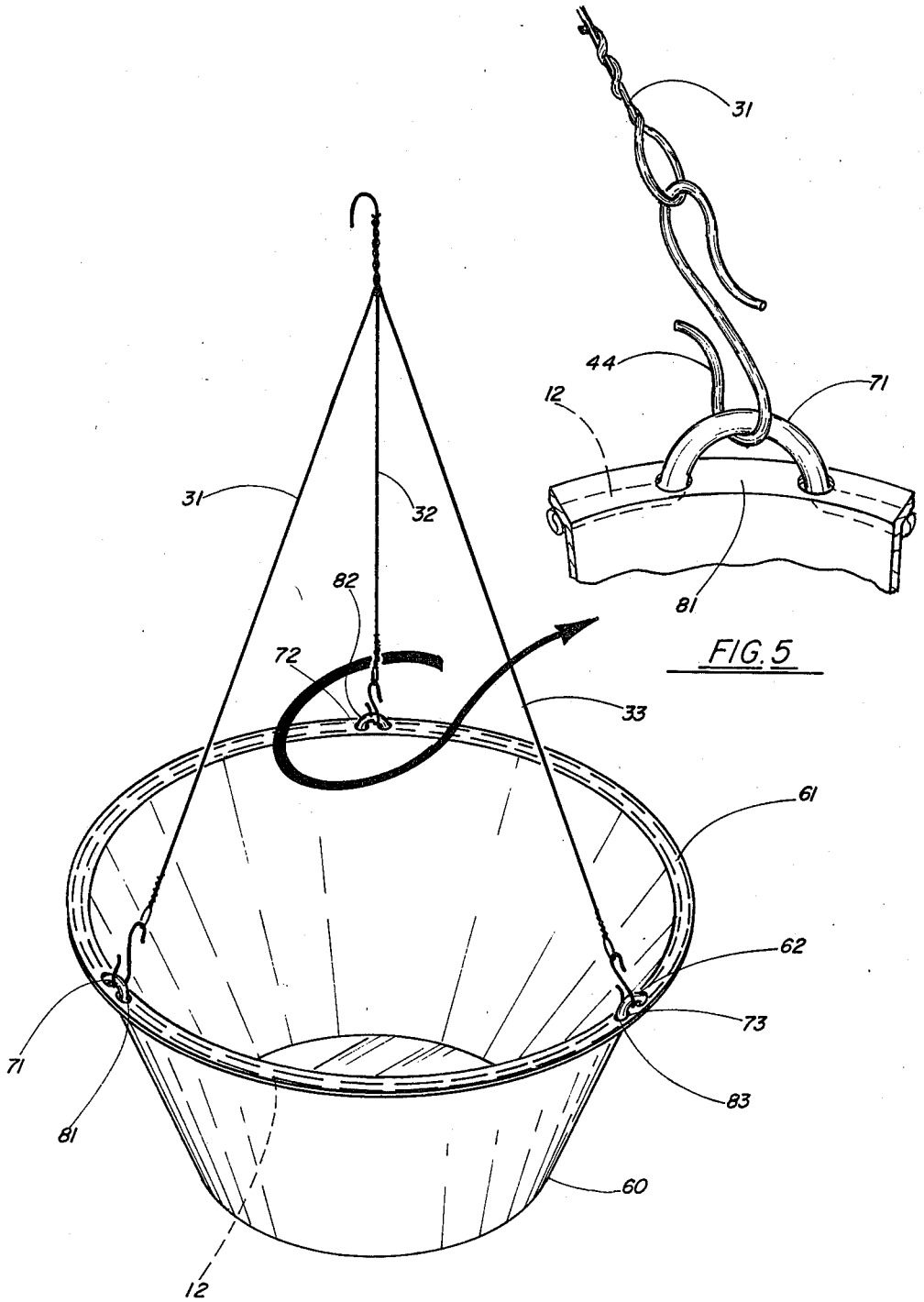
FIG. 4 is a perspective view of an additional embodiment of the apparatus of the present invention illustrating the support wire extruding through the top lip edge of a plastic or the like hanger.
FIG. 5 is an exploded sectional view of the additional embodiment of the apparatus of the present invention wherein the support wire is illustrated extruding out from the lip of the plastic pot.

In an additional embodiment of apparatus 10, as illustrated by FIG. 4, the apparatus is shown as it would underlie a lip portion 61 of plastic hanger pot 60. The extrusions 71, 72 and 73 would be allowed to extrude upward through the surface 62 of said lip 61, and thus, extrude out from the top of surface 62. It should be noted from FIG. 4, that the variable S-hook would still be utilized on the hanging wires 31, 32 and 33, and thus, would be able to support said apparatus 10 in the same manner as the previous embodiment. The utilization of the present invention in this particular embodiment, is very important in the state of the art, since, at the present time, apparatus 10 would not necessarily be utilized in the area of plastic plant hangers. As discussed in the previous section, the present embodiments required that hanging wires 31, 32 and 33 simply be attached to said hanger planter 60 via slots 81, 82 and 83 in top lip 61. This support, in such cases, is very weak, and often results in breakage in the plant hanger at that point. In the present invention, it should be noted that apparatus 10 would support the entire lip portion 61 of plant hanger apparatus 10, thus the weight of the pot 60 would be distributed throughout the entire circumference of the hanger 10, thus enabling it to support a much greater weight for a longer period of time.

FIG. 4 would illustrate the ease by which variable U-hook 44 could be attached to said extrusion 71 in this particular embodiment, thus making it quite simple to attach and detach said pot from said hanging apparatus.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limited sense.

What is claimed as invention is:

1. An apparatus for hanging plant pots having an annular lip portion, comprising:

a. a continuous wire surrounding the exterior of the pot to be hung directly below and in contact with the lower surface of the lip portion of the pot to be hung;

b. at least three upper extending loop portions of said wire, said loop proportions extending through orifices in said lip portion, providing attachment points thereon to;

c. at least three hanger wires, a first and of each form a connection between each of said upper extending proportions;

d. at least three modified "S" hooks defining a first lower loop portion for connecting onto each of said upward loop portions and a second upper loop portion for connecting onto the ends of each of said hanging wires.

2. The apparatus in claim 1, wherein said modified "S" hook would be detachable from said loop portion and from said hanging wire.

3. The apparatus in claim 1, wherein said continuous wire below said annular lip portion would serve as the support for said plastic pot to be hung.

* * * * *